US009962812B2

(12) United States Patent
Schlüssel

(10) Patent No.: US 9,962,812 B2
(45) Date of Patent: May 8, 2018

(54) CENTRIC CLAMPING DEVICE

(71) Applicant: GRESSEL AG, Aadorf (CH)

(72) Inventor: Marcel Schlüssel, Bassersdorf (CH)

(73) Assignee: GRESSEL AG, Aadorf (CH)

( * ) Notice: Subject to any disclaimer, the term of this patent is extended or adjusted under 35 U.S.C. 154(b) by 179 days.

(21) Appl. No.: 14/805,020

(22) Filed: Jul. 21, 2015

(65) Prior Publication Data

US 2016/0023329 A1 Jan. 28, 2016

(30) Foreign Application Priority Data

Jul. 23, 2014 (DE) ..... 10 2014 110 352

(51) Int. Cl.
*B25B 1/24* (2006.01)
*B25B 1/10* (2006.01)

(52) U.S. Cl.
CPC ..... *B25B 1/103* (2013.01); *B25B 1/2405* (2013.01); *B25B 1/2489* (2013.01); *B25B 1/24* (2013.01); *B25B 1/2484* (2013.01)

(58) Field of Classification Search
CPC ..... B25B 1/2405; B25B 1/103; B25B 1/2489; B25B 1/24; B25B 1/2484
See application file for complete search history.

(56) References Cited

U.S. PATENT DOCUMENTS 1,811,299 A * 6/1931 Brockhaus, Jr. ..... B25B 1/103 269/242
3,720,116 A * 3/1973 Better ..... F16H 25/2209 74/409
4,413,818 A * 11/1983 Lenz ..... B25B 1/2484 269/244
4,429,887 A * 2/1984 Smith ..... B23B 31/1605 269/74
4,591,199 A * 5/1986 Zajac ..... B25B 1/18 269/32
4,934,674 A * 6/1990 Bernstein ..... B25B 1/103 269/136
5,501,118 A * 3/1996 Benton ..... F16H 25/2209 470/2

(Continued)

FOREIGN PATENT DOCUMENTS

DE 29723435 U1 8/1998
DE 102007027808 B3 8/2008

(Continued)

OTHER PUBLICATIONS

Search result of Examination Report for German Patent Application No. 10 2014 110 352.1 filed Jul. 23, 2014.

*Primary Examiner* — Christopher M Koehler
*Assistant Examiner* — Seahee Yoon
(74) *Attorney, Agent, or Firm* — Paul D. Bianco; Gary S. Winer; Fleit Gibbons Gutman Bongini & Bianco PL

(57) ABSTRACT

A centric clamping device, which contains a main body, two clamping jaws, guided so they can be displaced on the main body, and an adjusting spindle, supported by a spindle bearing so that it can rotate on the main body for the opposing adjustment of the two clamping jaws. A high-precision spindle bearing, optimally protected against soiling, is attained in that the spindle bearing is located in a bearing block and two bearing sleeves, which can be adjusted axially within the bearing block.

18 Claims, 4 Drawing Sheets

(56) References Cited

U.S. PATENT DOCUMENTS

| | | | | |
|---|---|---|---|---|
| 6,017,026 | A * | 1/2000 | Durfee, Jr. | B25B 1/103 269/134 |
| 6,079,704 | A * | 6/2000 | Buck | B25B 1/103 269/195 |
| 8,256,753 | B2 * | 9/2012 | Teo | B25B 1/103 269/240 |
| 2006/0037419 | A1 * | 2/2006 | Osterlanger | F16H 25/24 74/89 |
| 2010/0164159 | A1 | 7/2010 | Würthele | |
| 2014/0131933 | A1 * | 5/2014 | Taylor | B25B 1/2489 269/165 |

FOREIGN PATENT DOCUMENTS

| | | | |
|---|---|---|---|
| DE | 102012112755 | A1 | 6/2014 |
| DE | 102013104467 | A1 | 6/2014 |
| DE | 202004009517 | U1 | 10/2014 |
| EP | 1688219 | A1 | 8/2006 |

* cited by examiner

CENTRIC CLAMPING DEVICE

FIELD OF THE DISCLOSURE

The disclosure concerns a centric clamping device.

BACKGROUND

Centric clamping devices usually have a main body, which can be clamped, for example, on a machine table, two clamping jaws that are guided so they can be displaced on the main body via longitudinal guides, and an adjusting spindle for the opposing adjustment of the two clamping jaws. With the aid of the adjusting spindles, the clamping jaws, situated so they can be displaced on the main body, can be simultaneously moved apart and together, wherein a centric clamping of workpieces is made possible.

From DE 10 2012 112 755 A1, a generic centric clamping device is known. It has a main body, two clamping jaws that are guided so they can be displaced on the main body, and an adjusting spindle that is supported on the main body so it can rotate by means of a spindle bearing for the opposing adjustment of the two clamping jaws. In this known clamping device, the spindle support consists of a bearing support that is affixed to the main body by means of screws, which contains a shell-shaped bearing bridge to engage with an annular groove of the adjusting spindle.

In DE 20 2004 009 517 U1, a clamping device with a main body and two clamping jaws is disclosed; the jaws are situated opposite one another on the main body and are guided in a displaceable manner toward one another and away from one another along a common axle. The adjustment of the clamping jaws is carried out via an adjusting spindle, which is supported so it can rotate in a central bearing housing and, on its end sections, has external threaded sections with opposite gradients, which are screwed into the clamping jaws.

DE 10 2013 104 467 A1 discloses a centric clamping device in which two clamping jaws that can be adjusted contrary to one another on a main body are guided in such a manner that they can be displaced. The clamping jaws can be adjusted via a threaded spindle that is supported so it can rotate in a middle bearing block.

DE 297 23 435 U1 discloses a centric clamping device with two linearly guided clamping slides that can be moved relative to one another. The adjustment of the clamping slides is carried out by a threaded spindle that is supported so it can rotate within a bearing block; the spindle has opposing threaded sections on its two ends for engagement with threaded nuts of two pistons.

From EP 1 688 219 A1 is known a clamping device with a first clamping jaw that is firmly situated on a main body and a second clamping jaw that is guided so it can be adjusted on the main body. The second clamping jaw can be adjusted by means of a screw spindle that is situated in a spindle recess of the main body. To avoid soiling, the spindle recess of the main body between the two clamping jaws is covered by a cover element over the entire adjustment section of the clamping jaws.

DE 10 2007 027 808 B3 concerns a clamping device in which the carriers of the clamping jaws are designed as half-shells that enclose the adjusting spindle.

SUMMARY OF THE DISCLOSURE

A centric clamping device, which contains a high-accuracy spindle bearing that is optimally protected against soiling is disclosed. Appropriate refinements and advantageous embodiments are also disclosed.

In the centric clamping device in accordance with the invention, the spindle bearing is located in a bearing block and has two bearing sleeves which can be adjusted axially within the bearing block. By means of the axial adjustment of the two bearing sleeves, it is possible to not only set the axial position of the adjusting spindle relative to the main body, but via a contrary adjustment of the two bearing sleeves, the spindle bearing can also be pretensioned and adjusted free of play. In this way, a high degree of precision and a good repeatability can be attained. Furthermore, the adjusting spindle over the bearing block can be completely covered and sealed in the section of the bearing. The centric clamping device is thus impervious to chips and the adjusting spindle is protected against soiling in a closed system.

In an embodiment that can be adjusted in a particularly low-friction and precise-position manner, the spindle bearing can be designed as a roller bearing with several rolling elements conducted between the bearing sleeves and the adjusting spindle. For this, the adjusting spindle can have, for example, annular grooves at a distance from one another for the inside bearing of the rolling elements designed, for example, as spheres. The two bearing sleeves can contain a shoulder-shaped bearing surface on the front sides, facing one another, for the outside bearing of the rolling elements. By the mutual clamping of the two bearing sleeves, the shoulder-shaped bearing surfaces can be stopped at the spheres and an adjustment that is as free of play as is possible can thus be attained. However, the spindle bearing could also be designed as a slide bearing with axially adjustable slide bearing sleeves.

A simple axial adjustment of the bearing sleeves can be attained in that the two bearing sleeves have an external thread for engagement with a corresponding internal thread of a passage opening running through the bearing block.

In a particularly stable design, which is optimally protected from soiling, the bearing block, closed over its entire circumference, can be designed as a single part with the main body. An optimized chip discharge can be attained in that passages are arranged that have bottom surfaces leading downward at an incline, and also leading outward from indentations between the bearing block and two side wings of the main body.

In accordance with another advantageous embodiment, the two clamping jaws can be adjusted via sliders guided in a displaceable manner in the main body. The sliders can be incorporated into the main body in such a manner that a design is produced that is protected from soiling and impervious to chips. The adjusting spindle appropriately has two external threads that are made as right or left threads for engagement with corresponding internal threads on passage boreholes of the two sliders.

The clamping jaws are advantageously detachably fastened on the sliders. In this way, it is possible to replace the clamping jaws according to need and they can be adapted to the individual clamping task. The clamping jaws can have any arbitrary form.

BRIEF DESCRIPTION OF THE DRAWINGS

Other features and advantages of the disclosure can be deduced from the following description of a preferred embodiment example, with the aid of the drawing. The figures show the following.

DETAILED DESCRIPTION

Figure 1:
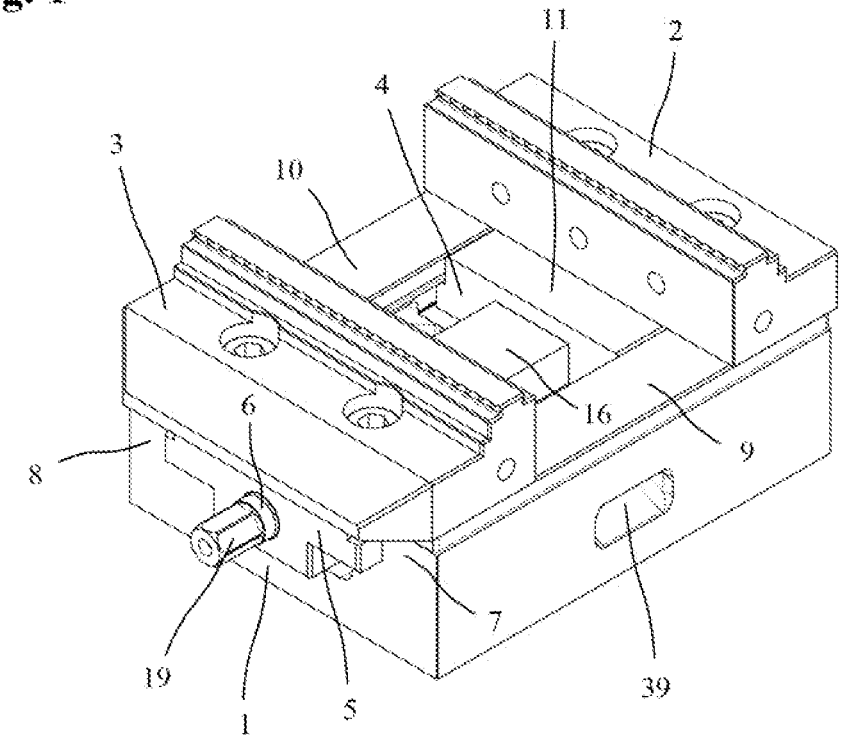
FIG. 1, a centric clamping device in accordance with the invention in a perspective from above.
Figure 2:
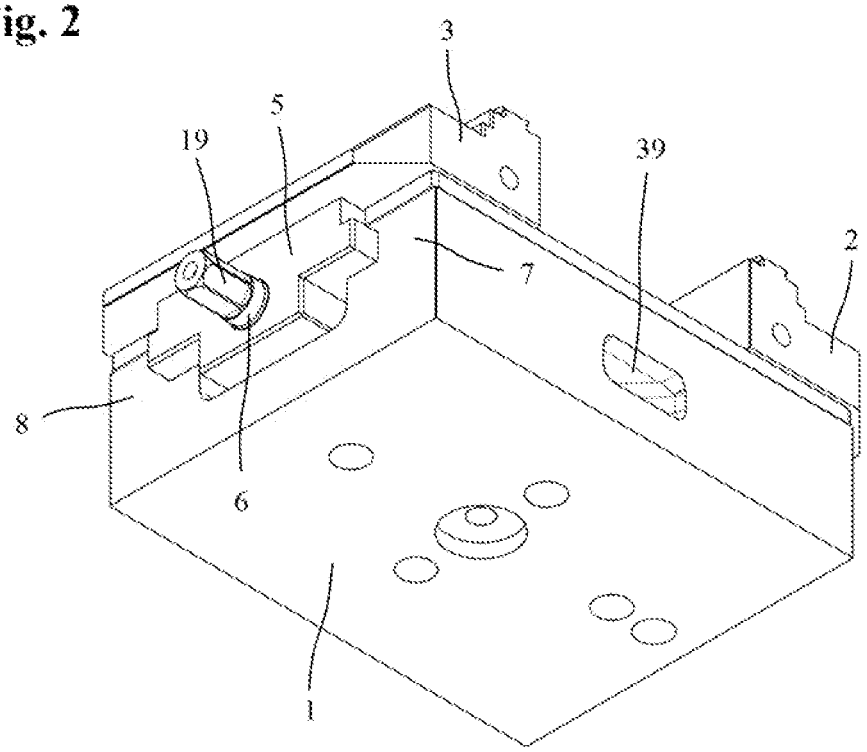
FIG. 2, the centric clamping device of FIG. 1 in a perspective from below.
Figure 3:
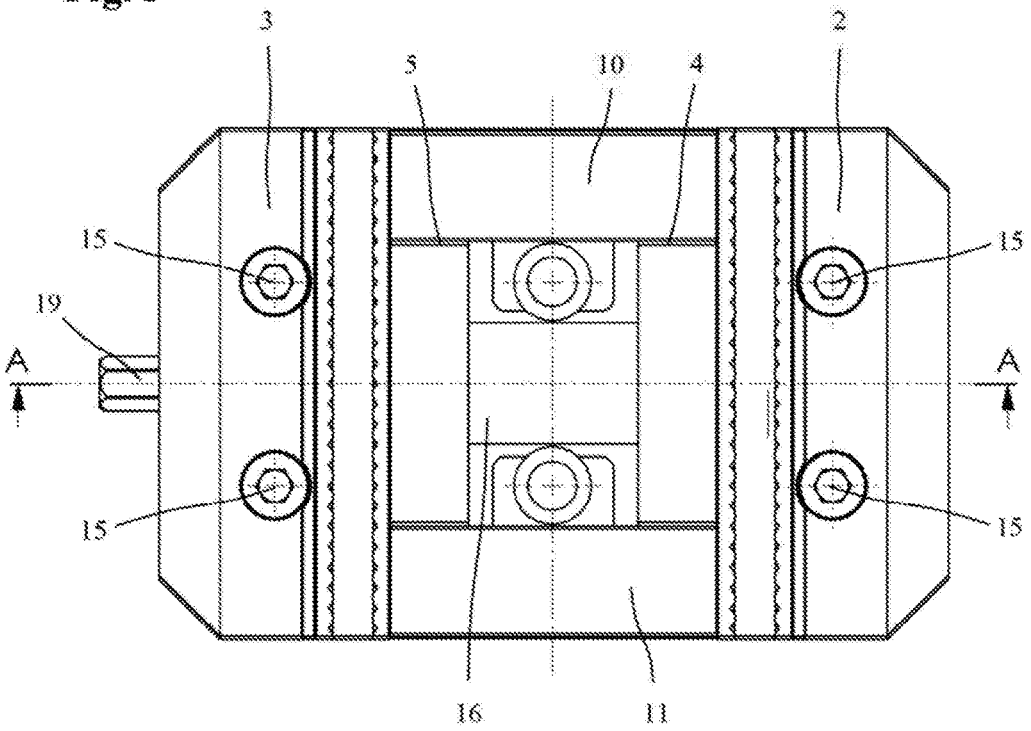
FIG. 3, the centric clamping device of FIG. 1 in a top view.

The centric clamping device shown in FIGS. 1 to 4 in different views contains a main body 1, on which two clamping jaws 2 and 3 are guided in a displaceable manner over sliders 4 and 5 and which can be adjusted in opposite directions by means of an adjusting mechanism with an adjusting spindle 6. The main body 1 has two side wings 7 and 8, at a distance from one another, with upper guide surfaces 9 and 10. In the embodiment shown, the two guide surfaces 9 and 10 are constructed on one hardened and ground upper part of the two side wings 7 and 8 of the main body 1. The guide surfaces 9 and 10, however, can also be situated on separate guide tracks or guide bars that can be replaced according to need. Between the two side wings 7 and 8 of the main body 1, the two sliders 4 and 5 are adapted and guided in such a way that they can be displaced. In the embodiment example shown, the sliders 4 and 5 have a step-shaped cross section with an upper stop surface 11.

Figure 4:
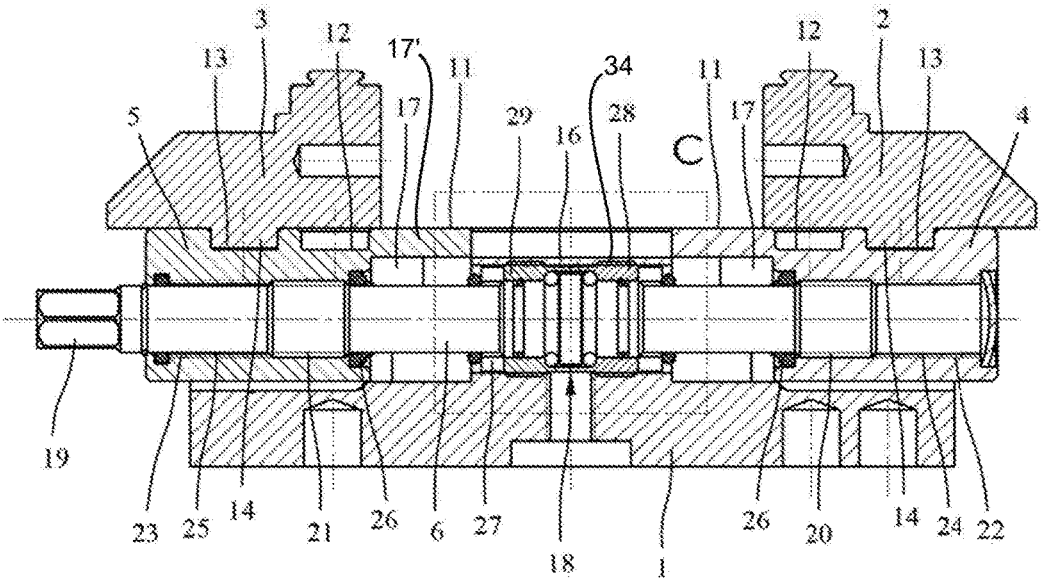
FIG. 4, the centric clamping device of FIG. 1 in a longitudinal section along the A-A line of FIG. 3.

As can be seen from FIG. 4, the upper stop surface 11 of each of the sliders 4 and 5 has two indentations 12 and 13 lying in the longitudinal direction of the main body 1, as seen one behind the other, for the form-locking engagement of an attachment 14 that projects downward from the underside of the clamping jaws 2 and 3. In this way, the clamping jaws 2 and 3 can be staggered inward or outward and can be fastened in a precise position on the individual sliders 4 or 5 by screws 15, which can be seen in FIG. 3. The clamping jaws 2 and 3 can have an arbitrary form that is adapted to the individual clamping task. In the embodiment shown, the clamping jaws 2 and 3 are made as reversible jaws with various clamping surfaces. By turning the clamping jaws 2 and 3, it is thus possible to simply expand or change the clamping section.

In the middle of the main body 1, between the two side wings 7 and 8, there is a bearing block 16, closed toward the top and to the side, for the support of the adjusting spindle 6. The 10 two sliders 4 and 5 each have a recess 17 or a cover 17', on the front sides, facing one another, to hold the bearing block 16 and to cover the adjusting spindle 6. In this way, the two sliders 4 and 5 are pushed together over the bearing block 16, with the covering of the adjusting spindle 6. By means of the recesses 17 or the covers on the sliders 4 and 5, the adjusting spindle 6 is covered and the chips are deflected. Within the bearing block 16, the adjusting spindle 6 can be 15 rotated around its longitudinal axle by a spindle bearing 18, which is explained in more detail below, and is securely supported in the axial direction.

From FIG. 4, one can see that the adjusting spindle 6, supported in the middle within the bearing block 16, contains an adjusting pin 19 that projects outward, opposite the main body 1 and the slider 5, and is provided here with an external hexagon, and two external threads 20 and 21, constructed as right or left threads, for engagement with corresponding internal threads 22 and 23 in passage boreholes 24 and 25 of the two sliders 4 and 5. By rotating the adjusting pin 19 with the aid of a suitable hand crank or another activation element, the two sliders 4 and 5 can thus be pushed opposite one another and the clamping jaws 2 and 3 can thus be simultaneously moved together or apart. Via ring-shaped sealing elements 26, the two sliders 4 and 5 are sealed on their front sides, facing one another, opposite the adjusting spindle 6.

Figure 5:
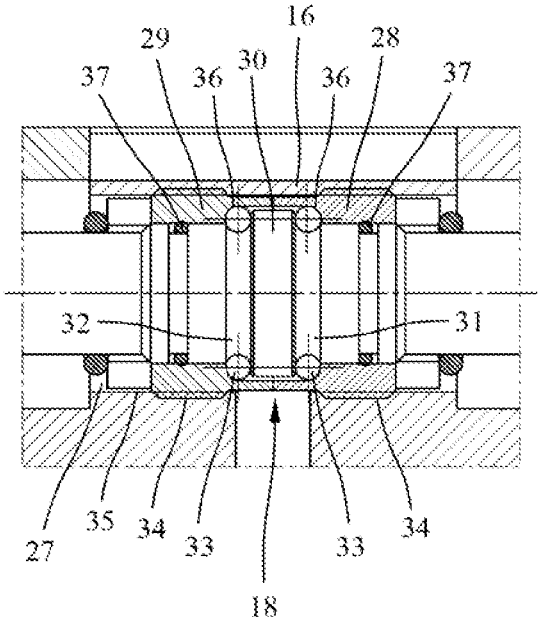
FIG. 5, an enlarged detail view of area C of FIG. 4.
Figure 6:
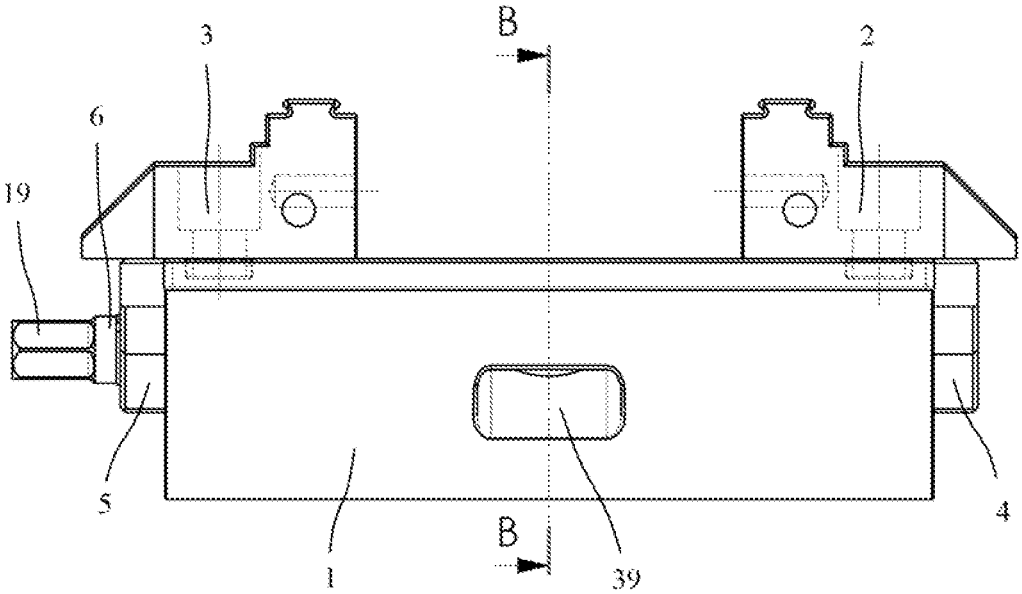
FIG. 6, the centric clamping device of FIG. 1 in a side view.

In the embodiment shown, the bearing block 16, shown in detail in FIG. 5, is made as one single part with the main body 1 and contains a passage opening 27, running in the longitudinal direction of the main body 1, in which the spindle bearing 18 for the adjusting spindle 6 is located. The spindle bearing 18 comprises two bearing sleeves 28 and 29, which are situated in such a way that they can be adjusted axially within the passage opening 27 and in which the adjusting spindle 6 is supported so it can rotate. The adjusting spindle 6 contains a central coil 30 and two annular grooves 31 and 32, which are provided to the right and left of the coil 30 and in which rolling elements 33, which are distributed over the circumference of the adjusting spindle 6, are supported. The two bearing sleeves 28 and 29 have an external thread 34 for engagement with a corresponding internal thread 35 of the passage opening 27 and on the front sides, facing one another, contain a shoulder-shaped bearing surface 36, on which the rolling elements 33, guided on the inside into two annular grooves 31 and 32 and designed here as spheres, stop on the outside. By a parallel adjustment of the two bearing sleeves 28 and 29 within the bearing block 16, the position of the adjusting spindle 6 can be set relative to the main body 1. The spindle bearing 18, on the other hand, can be pretensioned and adjusted free of play via a reciprocal adjustment of the two bearing sleeves 28 and 29.

Figure 7:
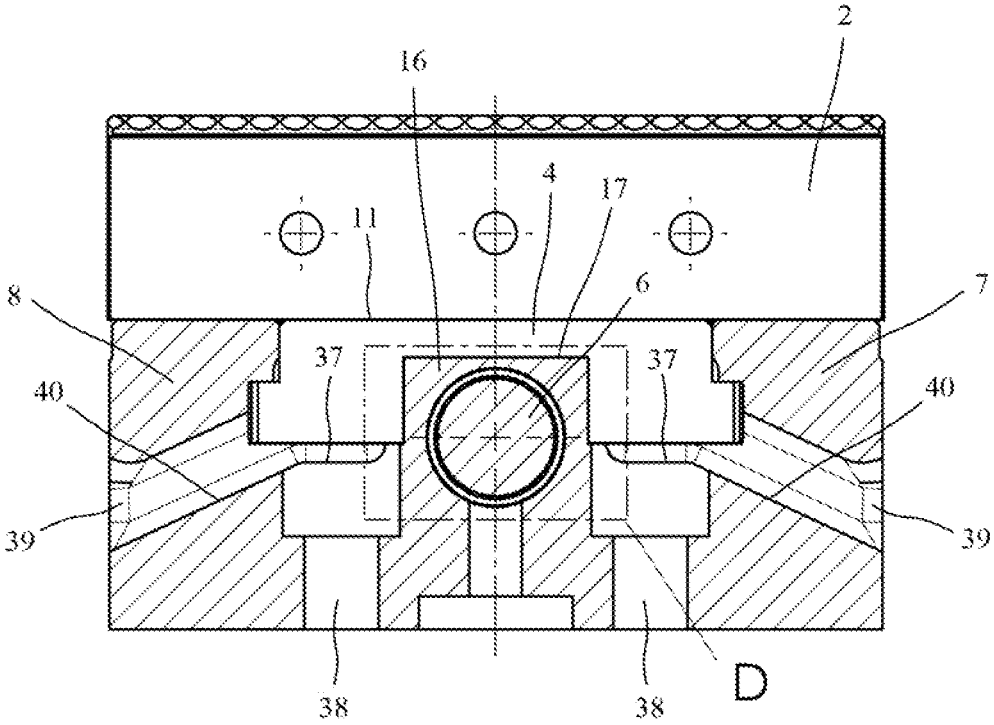
FIG. 7, a cross section along line B-B of FIG. 6.
Figure 8:
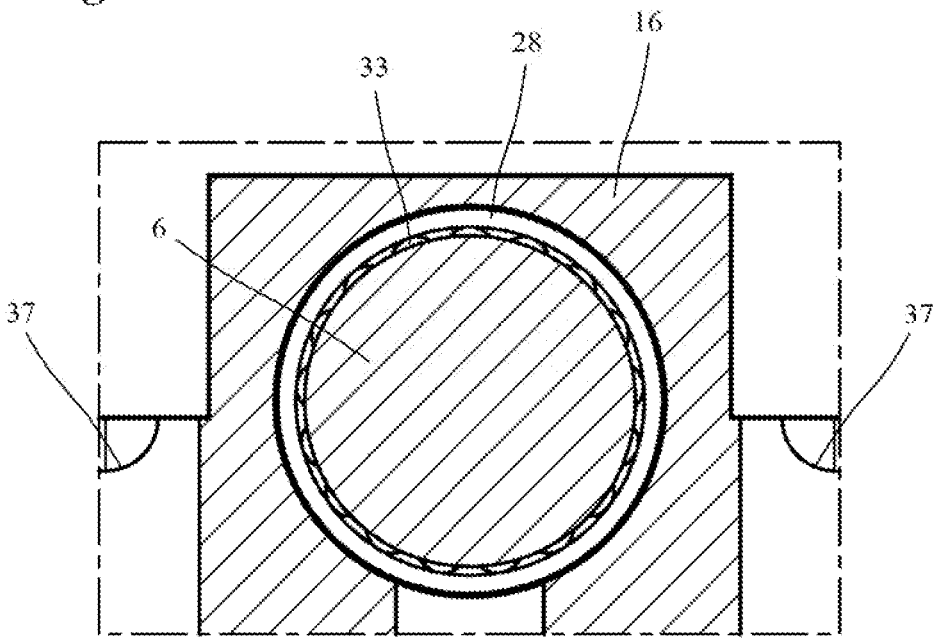
FIG. 8, an enlarged detail view of area D of FIG. 7.

In FIGS. 7 and 8, the central bearing block 16, located between the two side wings of the main body 1, is shown in cross section. Between the bearing block 16 and the two side wings 7 and 8 of the main body 1, indentations 37 with counterbores 38 are provided for the fastening of the main body 1 on a machine table or the like. In the two side wings 7 and 8, there are passages 39, guided outward from the indentations 37, with bottom surfaces 40, guided downward at an incline. In this way, chips arriving at the indentations 37 can be conducted outward in a simple and effective manner. By the recesses 17 or the covers on the sliders 4 and 5, the adjusting spindle 6 and also the bearing block 16 are covered and the chips are deflected to the indentations 37, and from there, via the passages 39, to the outside.

In the embodiment shown, the two clamping jaws 2 and 3 are designed as reversible jaws and have straight clamping surfaces on one side and stepped clamping surfaces on the other side. By turning the clamping jaws 2 and 3, the clamping section can thus be expanded in a simple manner. The clamping jaws 2 and 3, however, can also have any other, arbitrary form, adapted to the individual clamping task.

What is claimed is:

1. A centric clamping device comprising:

a main body, first and second clamping jaws, guided so the first and second clamping jaws are displaceable on the main body, and an adjusting spindle, supported by a spindle bearing so the spindle is rotatable on the main body for opposing adjustment of the first and second clamping jaws, wherein the spindle bearing is located in a bearing block and contains two bearing sleeves that are adjustable axially within the bearing block, wherein the first clamping jaw is positioned on a first slider and the second clamping jaw is positioned on a second slider, each of the first and second sliders guided so that the first and second sliders are displaceable in the main body, wherein each of the first and second sliders has an affixed cover movable with the respective slider and extending centrally to overlie and move over the bearing block and the adjusting spindle with the bearing block covering a central portion of the adjusting spindle and the first and second sliders covering end portions of the adjusting spindle as the first and second sliders are displaced, so that the adjusting spindle positioned within the main body is covered, thereby protecting the adjusting spindle from debris.

2. The centric clamping device according to claim 1, wherein the spindle bearing is a roller bearing with several rolling elements, located between the bearing sleeves and the adjusting spindle.

3. The centric clamping device according to claim 2, wherein the adjusting spindle contains two annular grooves, at a distance from one another, for an inside bearing of the roller bodies.

4. The centric clamping device according to claim 2, wherein the front sides of each of the two bearing sleeves have shoulder-shaped bearing surfaces, the respective shoulder-shaped bearing surfaces mutually facing one another, for an outside bearing of the roller bodies.

5. The centric clamping device according to claim 1, wherein the two bearing sleeves have an external thread for engagement with a corresponding internal thread of a passage opening that runs through the bearing block.

6. The centric clamping device according to claim 1, wherein the bearing block is a single part with the main body.

7. The centric clamping device according to claim 1, wherein the adjusting spindle contains two external threads, made as right or left threads, for engagement with corresponding internal threads on passage boreholes of the first and second sliders.

8. The centric clamping device according to claim 1, wherein the first clamping jaw is detachably fastened on the first slider and the second clamping jaw is detachably fastened on the second slider.

9. The centric clamping device according to claim 1, wherein the bearing block is located between two side wings of the main body.

10. The centric clamping device according to claim 9, wherein indentations are located between the bearing block and the two side wings.

11. The centric clamping device according to claim 10, wherein, in the two side wings, there are passages, guided outward from the indentations, with bottom surfaces guided downward at an incline.

12. The centric clamping device according to claim 1, wherein:

the bearing block has a passage in which the spindle bearing is located, the passage having internal threading that engage corresponding external threading on the two bearing sleeves, the adjusting spindle includes a central bearing having opposite sides, the two bearing sleeves each having a shoulder-shaped bearing surface positioned to align with and be contactable with one of the opposed sides of the central bearing, the bearing sleeves respectively rotatable in the same radial direction to contact one or more of the opposed sides to move the central bearing and thereby the spindle along the direction of an axis of the spindle, the bearing sleeves respectively rotatable in opposite radial directions to thereby adjust a tension of the clamping of the opposed sides to pretension the spindle with respect to the sliders.

13. A centric clamping device comprising:

a main body having a longitudinal recess and a spindle bearing block positioned within the longitudinal recess;

first and second movable clamping elements each having a threaded bore;

an adjusting spindle, the spindle having external threads, the threaded bore of each of the first and second movable clamping elements threaded onto the spindle, the spindle rotatable in a first direction to move the first and second clamping elements towards each other, and in a second direction opposite to the first direction to move the first and second clamping elements away from each other, the spindle including a bearing forming opposed side surfaces, the spindle bearing supported by the spindle bearing block to enable the spindle to be rotatable within the main body;

two bearing sleeves each positioned about the spindle, each having external threads mateable with respect to the main body to enable movement of the respective bearing sleeve along a longitudinal axis of the longitudinal recess of the body, each having a shoulder-shaped bearing surface positioned to align with and be contactable with one of the opposed sides of the spindle bearing, the bearing sleeves respectively threadably rotatable in the same radial direction to contact one or more of the opposed sides of the spindle bearing to move the spindle bearing and thereby the spindle along the direction of an axis of the spindle, the bearing sleeves respectively threadably rotatable in opposite radial directions to thereby adjust a tension of the contact of each of the bearing sleeves with a respective opposed side of the spindle bearing to thereby pretension an engagement of the spindle with respect to the bearing block.

14. The device of claim 13, wherein each of the first and second clamping elements has an affixed cover movable with the respective clamping element and extending centrally to overlie a portion of the longitudinal recess, bearing block, and adjusting spindle continuously as the first and second clamping elements are moved, so that the adjusting spindle positioned within the main body is covered by the affixed covers at all positions of the first and second clamping elements, thereby protecting the adjusting spindle from debris.

15. The device of claim 13, the spindle bearing block positioned centrally within the main body.

16. The device of claim 13, the spindle bearing block made as one single part with the main body and containing a longitudinal passage for the spindle.

17. The device of claim 13, the spindle bearing block forming a portion of a roller bearing block on each of two opposed sides.

18. The device of claim 13, the bearing sleeves configured to support replaceable clamping jaws each having a shape adapted to a given clamping task.

* * * * *